US011511177B2

(12) United States Patent
Zeidman et al.

(10) Patent No.: US 11,511,177 B2
(45) Date of Patent: Nov. 29, 2022

(54) POOL LAP COUNTER

(71) Applicants: Robert M. Zeidman, Las Vegas, NV (US); Carrie L. Zeidman, Las Vegas, NV (US)

(72) Inventors: Robert M. Zeidman, Las Vegas, NV (US); Carrie L. Zeidman, Las Vegas, NV (US)

(73) Assignee: Z Enterprises, Las Vegas, NV (US)

( * ) Notice: Subject to any disclaimer, the term of this patent is extended or adjusted under 35 U.S.C. 154(b) by 149 days.

(21) Appl. No.: 16/921,674

(22) Filed: Jul. 6, 2020

(65) Prior Publication Data

US 2022/0001260 A1 Jan. 6, 2022

(51) Int. Cl.
*A63B 71/06* (2006.01)

(52) U.S. Cl.
CPC .. *A63B 71/0672* (2013.01); *A63B 2071/0602* (2013.01); *A63B 2071/0658* (2013.01); *A63B 2071/0694* (2013.01); *A63B 2220/17* (2013.01); *A63B 2244/20* (2013.01)

(58) Field of Classification Search
CPC ..... A63B 2244/20; A63B 2220/17; A63B 2071/0602; A63B 71/0672; A63B 2017/0694; A63B 2017/0658; A63B 2017/0602
See application file for complete search history.

(56) References Cited

U.S. PATENT DOCUMENTS 630,128 A * 8/1899 Stock ..... A47B 91/04 248/188.9
1,099,009 A * 6/1914 Bennett ..... G09B 19/02 434/203
1,142,651 A * 6/1915 Winiecki ..... A47B 97/04 434/420
1,148,616 A * 8/1915 Paul et al. ..... G09B 19/02 434/416
2,541,664 A * 2/1951 Pollack ..... A47B 13/081 434/432
3,419,983 A * 1/1969 Hill ..... G09F 11/29 434/173
3,526,045 A * 9/1970 Stone ..... G09B 19/02 434/209
3,786,259 A * 1/1974 Frank ..... G01T 7/08 250/328

(Continued)

FOREIGN PATENT DOCUMENTS

EP 2120125 A1 11/2009
WO WO2012125114 A1 9/2012

OTHER PUBLICATIONS

Aqua Tally Lap counter at swimoutlet.com searched and found on Feb. 15, 2022.*

(Continued)

*Primary Examiner* — Daniel I Walsh

(74) *Attorney, Agent, or Firm* — Inventive Law Inc.; Jim H. Salter

(57) ABSTRACT

This invention is an inexpensive, easy-to-use, and easy-to-manufacture device that can be placed on the edge of a pool so that a swimmer can use it to count laps without significantly disrupting the swimming. The invention is lightweight and portable so that one person can carry it around, place it on the pool before swimming laps, and remove it afterwards.

11 Claims, 3 Drawing Sheets

(56) References Cited

U.S. PATENT DOCUMENTS 3,916,214 A * 10/1975 Coble, Jr. ..... A63B 71/0605 307/119
3,933,305 A * 1/1976 Murphy ..... G06G 1/0073 235/70 A
3,944,763 A * 3/1976 Beierwaltes ..... A63B 31/00 200/86 R
3,989,298 A * 11/1976 Cycowicz ..... A47C 4/02 297/317
4,023,345 A * 5/1977 Imamura ..... G04F 10/04 368/111
4,077,129 A * 3/1978 Nishikata ..... G01B 3/28 D10/73
4,518,266 A * 5/1985 Dawley ..... G04F 8/08 968/843
4,604,768 A * 8/1986 Goldfarb ..... E05F 5/06 16/86 A
4,674,740 A * 6/1987 Iams ..... A63B 69/10 482/901
4,700,369 A * 10/1987 Siegal ..... G07C 1/22 377/5
4,716,699 A * 1/1988 Crossman ..... E04B 2/7437 52/36.6
4,780,085 A * 10/1988 Malone ..... G07C 1/24 434/254
4,932,045 A 6/1990 Kasoff
4,993,004 A 2/1991 Loizeaux
5,136,621 A * 8/1992 Mitchell ..... G04F 10/00 377/5
5,149,269 A * 9/1992 Ylitalo ..... G09B 19/02 434/207
5,285,428 A * 2/1994 Rosow ..... G04F 8/08 368/107
5,334,026 A * 8/1994 Ylitalo ..... G06C 1/00 434/207
5,349,569 A * 9/1994 Tanaka ..... G07C 1/24 368/110
5,391,080 A * 2/1995 Bernacki ..... A63B 69/12 434/254
5,725,380 A * 3/1998 Kennelly ..... G09B 19/02 434/192
6,229,764 B1 * 5/2001 Tongue ..... A63B 69/0028 368/110
6,412,201 B1 * 7/2002 Traen ..... G09F 7/22 16/223
D462,629 S * 9/2002 Tran ..... D10/97
D513,762 S * 1/2006 Young ..... D18/6
7,014,468 B1 * 3/2006 Thorpe ..... G09B 19/02 434/188
7,029,170 B2 4/2006 Bailey
7,300,286 B2 * 11/2007 Palang ..... G06C 1/00 434/203
D558,271 S * 12/2007 Rule ..... D19/62
7,345,958 B1 3/2008 Kneafsey
D587,756 S * 3/2009 Rule ..... D19/62
7,641,590 B2 1/2010 Chan
7,828,553 B2 * 11/2010 Baerg ..... G09B 19/02 434/203
D674,441 S * 1/2013 Rule ..... D19/62
8,373,548 B2 2/2013 Stewart
8,406,085 B2 3/2013 Sakita
8,556,632 B2 * 10/2013 Boyer ..... G09B 19/00 434/246
8,696,420 B2 4/2014 Mueller
9,217,634 B1 12/2015 Firmin
9,529,437 B2 * 12/2016 Kahn ..... H04M 1/6058
D797,847 S * 9/2017 Zhang ..... D19/59
D812,131 S * 3/2018 Lengdorfer ..... D18/6
10,102,686 B2 * 10/2018 Oberhelman ..... A63B 69/12
D841,733 S * 2/2019 Herrmann ..... D18/6
10,252,143 B1 * 4/2019 Schott ..... G07C 1/24
D878,459 S * 3/2020 Rule ..... D19/64
2002/0172927 A1 * 11/2002 Faulkner ..... G09B 19/02 434/202
2005/0164023 A1 * 7/2005 Davis ..... B29C 51/16 264/510
2005/0225868 A1 * 10/2005 Nelson ..... A63B 33/002 351/159.02
2005/0239023 A1 * 10/2005 Watanabe ..... G09B 19/02 434/188
2005/0243651 A1 * 11/2005 Bailey ..... A63B 69/12 368/110
2006/0017222 A1 * 1/2006 Fournier ..... B65H 31/10 271/274
2007/0048708 A1 * 3/2007 Lee ..... G09B 19/02 434/156
2007/0076529 A1 * 4/2007 Lin ..... A63B 71/0686 368/107
2007/0161472 A1 * 7/2007 Drechsler ..... A63B 21/4017 482/99
2007/0166673 A1 * 7/2007 Frieman ..... G09B 19/02 434/203
2007/0182567 A1 * 8/2007 Stewart ..... A63B 71/0686 340/323 R
2008/0171310 A1 * 7/2008 Wiles ..... A63B 69/12 434/203
2008/0280102 A1 * 11/2008 Brouard ..... A47B 91/06 428/141
2008/0280273 A1 * 11/2008 Lee ..... G06C 1/00 434/203
2009/0171229 A1 * 7/2009 Saldarelli ..... A63B 69/12 4/496
2009/0185455 A1 * 7/2009 Medina-Brodsky ..... A63B 71/0686 368/107
2010/0019897 A1 1/2010 Stewart
2010/0304934 A1 * 12/2010 Woodson ..... A63B 24/0062 482/8
2012/0028229 A1 * 2/2012 Harte ..... G09B 19/02 434/203
2012/0097818 A1 * 4/2012 Desmarais ..... A47C 7/002 248/345.1
2013/0052617 A1 * 2/2013 Harte ..... G09B 23/02 434/203
2014/0106939 A1 * 4/2014 Kotz ..... A63B 31/00 482/55
2014/0272025 A1 * 9/2014 Wheeler ..... A47J 31/469 99/283
2016/0084869 A1 * 3/2016 Yuen ..... A63B 21/072 73/510
2016/0375334 A1 * 12/2016 Ragen ..... A63B 43/00 473/429
2016/0375342 A1 * 12/2016 Oberhelman ..... A63B 71/0686 700/92
2017/0028246 A1 * 2/2017 Vorozilchak ..... A63B 21/4029
2017/0102729 A1 * 4/2017 Ylitalo ..... G06C 1/00
2017/0289668 A1 * 10/2017 Kim ..... H04M 1/72412
2019/0275363 A1 * 9/2019 Jones ..... A63B 21/4035
2019/0282878 A1 * 9/2019 Gouzenko ..... A63B 69/18
2019/0369382 A1 * 12/2019 Chen ..... G02B 27/18
2019/0381385 A1 * 12/2019 Penn ..... A63B 61/006
2020/0015701 A1 * 1/2020 Wei ..... H01Q 1/526
2020/0140194 A1 * 5/2020 Tyrol ..... B65F 1/02
2021/0157354 A1 * 5/2021 Son ..... G06C 1/00
2021/0321773 A1 * 10/2021 Pierpont ..... A47B 97/00
2022/0001260 A1 * 1/2022 Zeidman ..... A63B 71/0672
2022/0040554 A1 * 2/2022 Ko ..... A63B 69/12
2022/0061525 A1 * 3/2022 Chen ..... A47B 88/407

OTHER PUBLICATIONS https://mobile.twitter.com/rekenrek, tweet of Jul. 9, 2018 (Year: 2018).*
Medley Swim Beads website, http://medleyswimbeads.com/about.html, published 2014.
Aqua Tally Swimming Lap Counter advertisement, Amazon.com, https://www.amazon.com/Aqua-Tally-Swimming-Lap-Counter/dp/B005CI8JEE, 2020.
Definition of plane, Merriam-Webster dictionary, https://www.merriam-webster.com/dictionary/plane.

(56) References Cited

OTHER PUBLICATIONS

Britannica Dictionary, plane, https://www.britannica.com/dictionary/plane.
The Inclined Plane, EDinformatics.com, https://www.edinformatics.com/math_science/simple_machines/inclined_plane.htm.
Joe Talbert, What is Antenna Ground Plane?, My Radio Lab, https://myradiolab.com/cb-antenna-ground-plane.

* cited by examiner

POOL LAP COUNTER

TECHNICAL FIELD

Embodiments of the present invention relate to a portable, inexpensive, easy-to-use, and easy-to-manufacture device for allowing a swimmer to keep count of the number of laps that have been swum.

BACKGROUND

We recently moved into a new house that had a swimming pool, and we started swimming for our regular exercise. Swimming is great cardio exercise as well as for developing the strength of muscles throughout the body. Plus it can be calming and relaxing. One of us likes to clear our mind of thoughts while swimming while the other prefers to consider problems and work on solutions while swimming. However, we both found it difficult to do anything but repeat the lap count in our head, "one, one, one . . . two, two, two . . . three, three, three . . . ." This counting defeated the calming effects we were looking for, and many times we would lose count, having to guess at which lap we were on.

We began searching for a solution for a lap counter online. We found some very simple solutions consisting of beads. One solution, the Medley® Swim Beads, was a string of beads that went across the entire width of the pool. It required a way to attach it to the pool sides, presumably by installing hooks on the sides of the pool, but we wanted something that did not require any kind of permanent installation. Also, the Medley Swim Beads stretched the entire length of the pool, meaning a swimmer had to aim for the spot where the next bead was to be moved and possibly move it half a pool width. This would require interrupting each lap to move the bead. Furthermore, it would not allow multiple swimmers to count laps.

Another product we found was the Aqua Tally Swimming Lap Counter, although there is very little information about it because the company appears to be out of business. The Aqua Tally Swimming Lap Counter is a small set of sliding beads on a rod that sits on the edge of the pool. The beads are very small, and reviews of the product say that they are difficult to slide, particularly with wet hands. The beads do not have numbers, so it is not readily apparent to the swimmer how many laps have been completed. Sliding the beads can cause the counter to wobble or tip over. Because it sits on the edge of the pool, the swimmer must stand up and reach out of the pool at the end of each lap to move a bead, interrupting the swimming.

In searching for prior art, we came across European patent application EP 2 120 125 A1 entitled "Counting device for swimming pools." One of the embodiments, shown in FIG. 3 of the application, is one or more rods with sliding rings to count the laps. However, this device uses suction cups to attach to the wall of the pool. Because pool surfaces are often made of plaster, suction cups will not adhere to them. If the pool wall is tile, the suction cups would need to be exactly the right size and distance to fit exactly in the center of the tiles. Although the embodiment that is described uses telescoping rods to change the distance, the size of the suction cups is fixed. Furthermore, suction cups that work underwater are not reliable. In fact, ordinary suction cups, like the one shown in the patent application, only stick to a dry surface that can be filled with water afterwards, requiring that this device be placed in the pool before filling it and then it must remain there until the pool is drained, meaning it is not portable.

The only other solutions we found were electronic ones with switches, display screens, and touchpads. They are expensive to design and expensive to manufacture due to the electronic circuitry that must be designed, assembled, and tested. They are also expensive because of the need to maintain a tight seal on the device to keep the circuitry dry in the water. These costs would be passed onto the consumer. Also, these devices require batteries that will eventually wear out and need to be replaced regularly. We wanted an inexpensive solution that we could simply take to the pool when we wanted to swim laps and remove afterwards.

BRIEF DESCRIPTION OF THE DRAWINGS

The present invention is illustrated by way of example, and not by way of limitation, in the figures of the accompanying drawings and in which.

DETAILED DESCRIPTION

Embodiments of the invention are directed to an apparatus for allowing a swimmer to count laps while swimming. Embodiments of the invention make use of a basic knowledge of mechanical engineering.

The present invention is a mechanical system for allowing a swimmer to count the number of laps that the swimmer swims in a pool.

Figure 1:
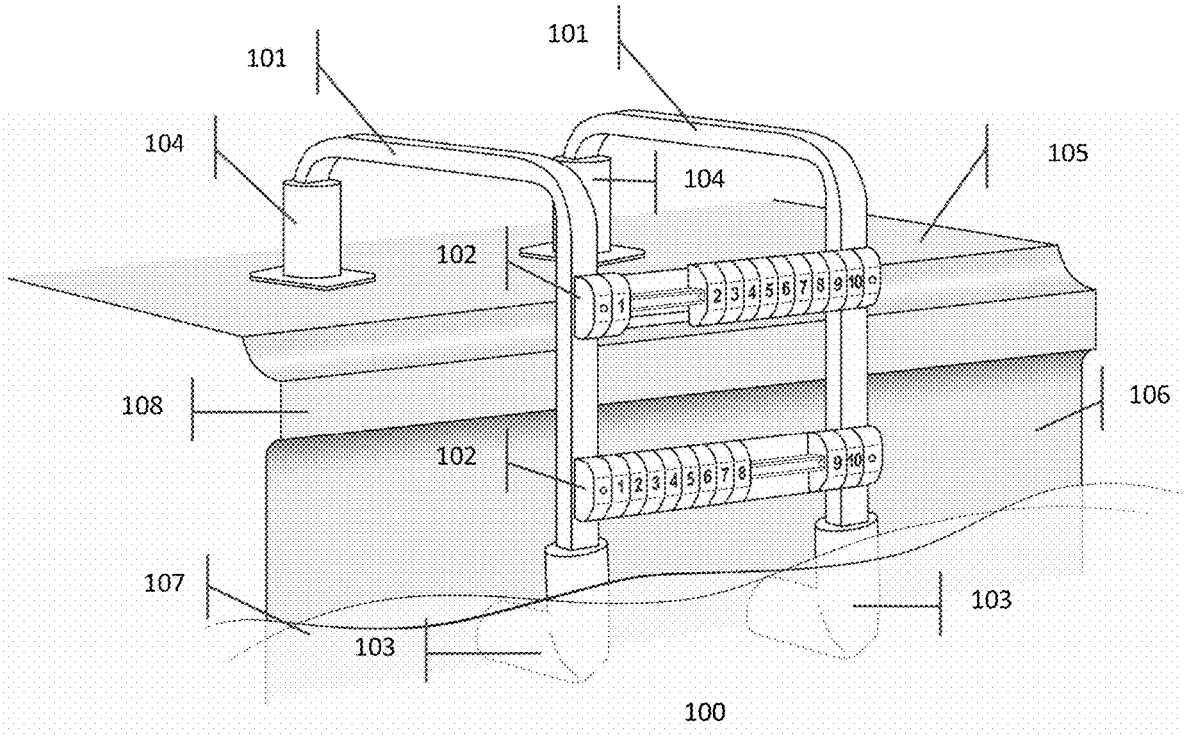
FIG. 1 shows an embodiment of the invention manufactured from discrete parts.

FIG. 1 shows an embodiment of the lap counter manufactured from discrete parts. Duplicate parts are used but are given a single number to indicate that they are identical. Lap Counter 100 consists of two Shelf Brackets 101 aligned in parallel such that the tops of the brackets form a horizontal plane that is parallel to the Pool Deck 105, and the sides of the brackets form a vertical plane that is parallel to the Pool Wall 106. For extra sturdiness, there can be more than two Shelf Brackets 101.

Attached to the Shelf Brackets 101 are one or more Sliding Counters 102, each with numbered pieces that can be slid left and right to indicate the number of laps swum. One Sliding Counter 102 can be used to count laps while a second Sliding Counter 102 can be used to count tens of laps and so on. If the Sliding Counters 102 are strong enough, they can be mounted directly onto the vertical portion of Shelf Brackets 101 with a screw on each end that goes through a hole in Sliding Counter 102 and a corresponding hole in Shelf Bracket 101. The screw can have a wing nut or other type of nut on the back to be tightened to be held in place. In this way, the Sliding Counters 102 provide the means of holding the Shelf Brackets 101 together. If the Sliding Counters 102 are not sufficiently strong, metal or other kinds of strips can be placed behind Sliding Counters 102, with corresponding screw holes, to provide additional strength. Also, a strip of metal or other strong material (not shown) can be placed diagonally between Shelf Brackets 101 as a brace against twisting. Shelf Brackets 101 can have vertical slots rather than screw holes so that the height of Sliding Counters 102 can be adjusted by the user such that Sliding Counters 102 are above Water Level 107 or below Water Level 107 as desired.

Weighted Feet 104 are attached to Shelf Brackets 101 to weigh down the back of Lap Counter 100 and thus keep the device from sliding into the pool. Right-angle Counter Feet 103 are attached to the device to keep Lap Counter 100 away from the Pool Wall 106 so that the device will not scrape against Pool Wall 106 or Pool Ledge 108 that may extend beyond Pool Wall 106.

Figure 2:
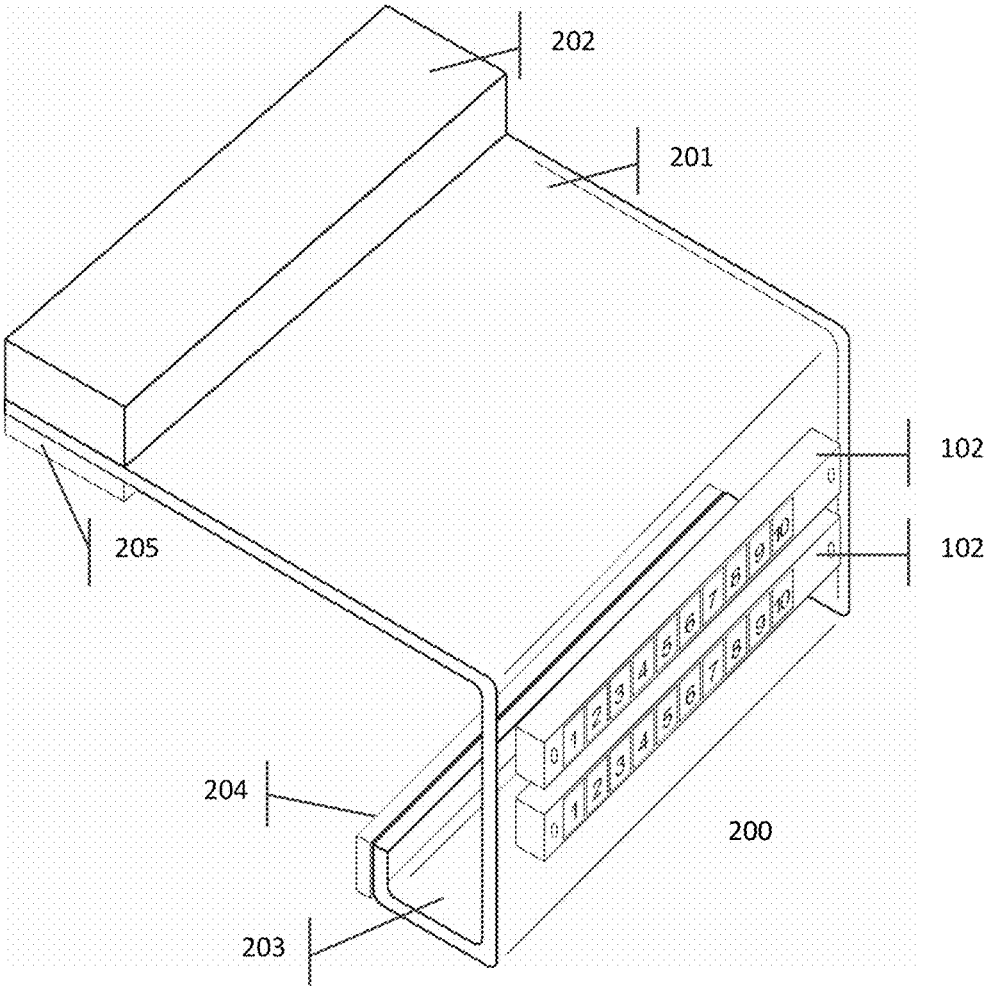
FIG. 2 shows a second embodiment of the invention where the base is manufactured as a single piece.

FIG. 2 shows a second embodiment of the Lap Counter 200 where the Counter Base 201 is manufactured as an extended J-shaped piece that has attached to it Back Weight 202 to weigh down the back of Lap Counter 200 and thus keep the device from sliding into the pool. Back Weight 202 can be an integral part of Counter Base 201 or a separate piece that is attached to Counter Base 201. Counter Lip 203 keeps Lap Counter 200 away from the Pool Wall 106 so that the device will not scrape against Pool Wall 106 or Pool Ledge 108 that may extend beyond Pool Wall 106.

Attached to the Counter Base 201 are one or more Sliding Counters 102, each with numbered pieces that can be slid left and right to indicate the number of laps swum. Sliding Counters 102 are mounted directly onto the vertical portion of Counter Base 201 with a screw on each end that goes through a hole in Sliding Counter 102 and a corresponding hole in Counter Base 201. The screw can have a wing nut or other type of nut on the back to be tightened to be held in place. Counter Base 201 can have vertical slots rather than screw holes so that the height of Sliding Counters 102 can be adjusted by the user such that Sliding Counters 102 are above Water Level 107 or below Water Level 107 as desired.

Optionally, Counter Base 201 can have a Padded Wall Strip 204 attached to Counter Lip 203 to keep it snug against the Pool Wall 106 without scraping it. Similarly, Counter Base 201 can have a Padded Deck Strip 205 attached to the bottom of Counter Base 201 to keep it snug on top of the Pool Ledge 108 without scraping it.

Figure 3:
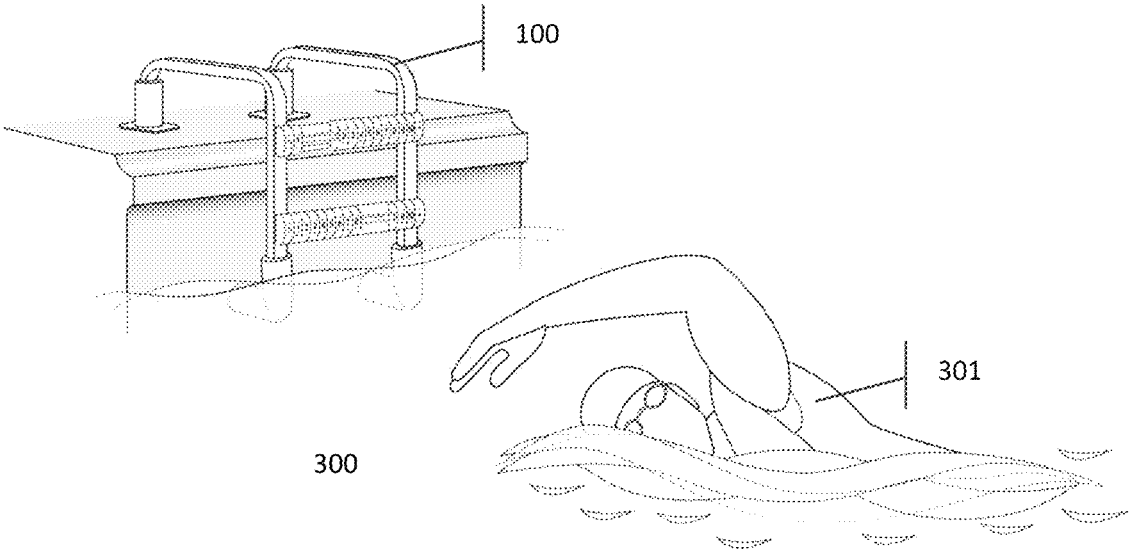
FIG. 3 shows the invention in use in a swimming pool.

FIG. 3 shows the lap counter in use in a swimming pool. Lap Counter 100 or Lap Counter 200 sits on the edge of the pool at one end of Swimming Pool 300. When Swimmer 301 reaches the end of the pool where Lap Counter 100 or Lap Counter 200 sits, Swimmer 301 slides the next number on the Sliding Counters 102 of Lap Counter 100 or Lap Counter 200 to indicate that another lap has been swum.

In the preceding description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

I claim:

1. An apparatus for counting swim laps, comprising:
a horizontal finite planar surface;
a vertical finite planar surface, directly connected to said horizontal finite planar surface;
one or more manually sliding counters where both ends of each of said one of more manually sliding counters are attached to said vertical finite planar surface;
one or more weights attached to said horizontal finite planar surface at an end farthest from the vertical finite planar surface;
a second horizontal finite planar surface attached to form a right angle to said vertical finite planar surface at an end farthest from said horizontal finite planar surface, and wherein the horizontal surface is configured to rest on a pool deck perpendicular to a pool wall when the second horizontal finite surface is configured to rest against the pool wall perpendicular to the pool deck.

2. The apparatus of claim 1 where said manually sliding counters are attached using screws through vertical slots in said vertical finite planar surface to allow adjusting the height of said sliding counters.

3. An apparatus for counting swim laps, comprising:
two or more brackets in parallel to each other, each bracket being a singular linear piece that has been bent to have at least three substantially ninety degree bends, each bracket having a first side connected to and perpendicular to to a second side, each bracket having feet extending from each end of each bracket where a foot at one end of said bracket has a contact surface that is perpendicular to a contact surface of a foot at an opposite end of said bracket, such that each bracket has a first contact surface configured to rest on a pool deck when a second contact surface is configured to rest on a pool wall perpendicular to said pool deck; and
a manually sliding counter where:
a first end of said manually sliding counter is connected to said second side of a first of said two or more brackets; and
a second end of said manually sliding counter is connected to said second side of a second of said two or more brackets, each of the one or more manually sliding counters having a plurality of pieces that can be manually slid left and right to indicate a number of laps swum by a swimmer swimming in a pool.

4. The apparatus of claim 3 where said first and second ends of said manually sliding counter are removably connected to said first and second of said two or more brackets using screws through vertical slots in said second sides of said first and second of said two or more brackets to allow adjusting the height of said manually sliding counters.

5. The apparatus of claim 3 including:
a first foot on said first side of said first of said two or more brackets, connected perpendicular to said first side of said first of said two or more brackets;
a second foot on said first side of said second of said two or more brackets, connected perpendicular to said first side of said second of said two or more brackets;
a third foot on said second side of said first of said two or more brackets, connected perpendicular to said second side of said first of said two or more brackets; and
a fourth foot on said second side of said second of said two or more brackets, connected perpendicular to said second side of said second of said two or more brackets.

6. An apparatus for counting swim laps, the apparatus comprising:
an extended J-shaped piece being a singular component having at least three rounded bends, the J-shaped piece further including a horizontal finite planar surface, a vertical finite planar surface, and a lip; and
one or more sliding counters attached to the vertical finite planar surface of said extended J-shaped piece, each of the one or more manually sliding counters having a plurality of pieces that can be manually slid left and right by a swimmer swimming in a pool to indicate a number of laps swum, where both ends of each of said one or more manually sliding counters are attached to said vertical finite planar surface, the vertical finite planar surface of the extended J-shaped piece having vertical slots to enable an attachment height of the plurality of manually sliding counters to be adjusted vertically; wherein the apparatus includes non-slip padding on a vertical portion of the lip of said extended J-shaped piece configured to rest on a pool wall when the horizontal planar surface is configured to rest on a pool deck perpendicular to the pool wall.

7. The apparatus of claim 6 including a weight attached to the horizontal finite planar surface of said extended J-shaped piece.

8. The apparatus of claim 6 including non-slip padding on a vertical portion of the lip of said extended J-shaped piece.

9. The apparatus of claim 6 including non-slip padding underneath said horizontal finite planar surface of said extended J-shaped piece.

10. An apparatus for counting swim laps, comprising:

a horizontal finite planar surface;

a vertical finite planar surface, directly connected to said horizontal finite planar surface one or more manually sliding counters where both ends of each of said one of more manually sliding counters are attached to said vertical finite planar surface;

non-slip padding on the bottom of said horizontal finite planar surface;

a second horizontal finite planar surface attached to form a right angle to said vertical finite planar surface at an end farthest from said horizontal finite planar surface, and wherein the horizontal surface is configured to rest on a pool deck perpendicular to a pool wall when the second horizontal finite surface is configured to rest against the pool wall perpendicular to the pool deck.

11. The apparatus of claim 10 where said manually sliding counters are attached using screws through vertical slots in said vertical finite planar surface to allow adjusting the height of said sliding counters.

* * * * *